US012774604B2

(12) United States Patent
Bunker, II

(10) Patent No.: US 12,774,604 B2
(45) Date of Patent: Oct. 27, 2026

(54) DRIP GUTTER

(71) Applicant: Innovations Manufacturing, Inc., Denver, CO (US)

(72) Inventor: Owen Woodruff Bunker, II, Denver, CO (US)

(73) Assignee: Innovations Manufacturing, Inc., Denver, CO (US)

( * ) Notice: Subject to any disclaimer, the term of this patent is extended or adjusted under 35 U.S.C. 154(b) by 93 days.

(21) Appl. No.: 18/667,797

(22) Filed: May 17, 2024

(65) Prior Publication Data

US 2025/0354384 A1 Nov. 20, 2025

Related U.S. Application Data

(60) Provisional application No. 63/490,916, filed on Mar. 17, 2023.

(51) Int. Cl.
*E04D 13/04* (2006.01)

(52) U.S. Cl.
CPC ..... *E04D 13/0445* (2013.01)

(58) Field of Classification Search
CPC ..... E04D 13/15; E04D 13/0459; E04D 2013/0468; E04D 13/158; E04D 13/0445; E04B 1/003
See application file for complete search history.

(56) References Cited

U.S. PATENT DOCUMENTS 3,568,391 A * 3/1971 Conway ..... E04F 19/061 52/364
3,939,616 A * 2/1976 Schapker ..... E04D 13/064 52/97
5,694,723 A * 12/1997 Parker ..... E02D 27/32 404/4
5,771,643 A * 6/1998 Parker ..... E02D 27/32 52/302.1
5,960,591 A * 10/1999 Schluter ..... E04D 13/0722 248/48.1
6,119,429 A * 9/2000 Bifano ..... E04F 13/06 52/302.3
6,134,847 A * 10/2000 Bifano ..... E04D 13/152 52/302.3
6,298,609 B1 * 10/2001 Bifano ..... E04F 19/02 52/302.3
6,308,470 B1 * 10/2001 Durkovic ..... E04B 1/70 405/36
6,470,638 B1 * 10/2002 Larson ..... E04B 1/765 52/302.1
6,591,559 B2 * 7/2003 Contreras ..... E04F 13/0889 52/302.3

(Continued)

*Primary Examiner* — Rodney Mintz
(74) *Attorney, Agent, or Firm* — Kilpatrick Townsend & Stockton LLP

(57) ABSTRACT

Embodiments of the present technology may encompass drip gutters. The drip gutters may include a vertical member. The drip gutters may include a horizontal member extending laterally outward from the vertical member. At least a portion of the vertical member may extend upward above the horizontal member. The drip gutters may include a vertical lip extending upward from a surface of the horizonal member and laterally spaced apart from the vertical member such that an open-topped drainage channel is formed between the vertical member, the horizontal member, and the vertical lip.

19 Claims, 6 Drawing Sheets

(56) References Cited

U.S. PATENT DOCUMENTS 8,015,756 B2 * 9/2011 Bonshor ..... E06B 1/62 52/302.1
8,561,357 B2 * 10/2013 Teodorovich ..... E06B 1/62 52/302.6
8,959,842 B2 * 2/2015 Norwood ..... E04B 1/66 52/60
9,194,171 B2 * 11/2015 Norwood ..... E06B 1/68
9,771,753 B2 * 9/2017 Norwood ..... E04B 1/66
9,828,774 B2 * 11/2017 Givens ..... E04D 13/15
9,909,352 B2 * 3/2018 Norwood ..... E06B 7/14
10,060,126 B2 * 8/2018 Collins ..... E04B 2/28
10,669,721 B2 * 6/2020 Baltz, Jr. ..... E04F 19/061
10,858,847 B2 * 12/2020 Erickson ..... E04D 13/15
10,889,991 B2 * 1/2021 Folkersen ..... E04D 13/1585
11,266,142 B1 * 3/2022 Bishop ..... E04D 13/004
11,560,748 B2 * 1/2023 Norwood ..... E04B 1/665
11,591,800 B2 * 2/2023 Gori ..... E04D 13/076
11,828,067 B2 * 11/2023 Lenney ..... E04D 13/0685
12,467,646 B2 * 11/2025 Anderberg ..... F24F 13/0209
2002/0139060 A1 * 10/2002 Contreras ..... E04B 1/762 52/293.3
2003/0177708 A1 * 9/2003 Gatherum ..... E04D 13/1415 52/62
2003/0177709 A1 * 9/2003 Gatherum ..... E04D 13/1475 52/62
2003/0177712 A1 * 9/2003 Gatherum ..... E04D 13/158 52/60
2003/0177736 A1 * 9/2003 Gatherum ..... E04D 13/1475 52/741.1
2004/0163330 A1 * 8/2004 Crum ..... E04D 13/064 49/408
2006/0260216 A1 * 11/2006 Bonshor ..... E06B 1/62 52/97
2008/0005975 A1 * 1/2008 Thompson ..... E04B 1/003 52/62
2008/0244987 A1 * 10/2008 Clausi ..... E04D 13/0459 52/741.1
2010/0162634 A1 * 7/2010 Teodorovich ..... E06B 1/62 52/211
2011/0197520 A1 * 8/2011 Preston ..... E04D 3/40 428/339
2011/0232204 A1 * 9/2011 Shugart ..... E04D 13/158 52/746.11
2011/0258953 A1 * 10/2011 Finkelshteyn ..... E04B 5/268 52/309.1
2014/0041316 A1 * 2/2014 Norwood ..... E04B 1/66 52/745.19
2014/0208682 A1 * 7/2014 Norwood ..... E04B 1/665 264/271.1
2015/0167375 A1 * 6/2015 Norwood ..... E04B 1/665 52/62
2017/0226732 A1 * 8/2017 Collins ..... E04B 1/765
2017/0226741 A1 * 8/2017 Givens ..... E04D 13/158
2017/0356237 A1 * 12/2017 Norwood ..... E06B 1/62
2018/0195336 A1 * 7/2018 Norwood ..... E04B 1/66
2018/0347197 A1 * 12/2018 Folkersen ..... E04D 13/158
2019/0186147 A1 * 6/2019 Baltz, Jr. ..... E04D 13/178
2020/0173180 A1 * 6/2020 Erickson ..... E04D 13/15
2021/0071425 A1 * 3/2021 Gori ..... G01B 3/14
2021/0108419 A1 * 4/2021 Folkersen ..... E04D 13/0459
2022/0403661 A1 * 12/2022 Lenney ..... E04D 13/0685
2024/0125496 A1 * 4/2024 Anderberg ..... F24F 13/0245
2025/0075507 A1 * 3/2025 Yachi ..... E04D 13/158

* cited by examiner

DRIP GUTTER

CROSS REFERENCE TO RELATED APPLICATIONS

This application claims priority to U.S. Provisional Patent Application No. 63/490,916 by Bunker II, et al., entitled "DRIP GUTTER," filed on Mar. 17, 2023, the entire disclosure of which is hereby incorporated by reference for all purposes.

BACKGROUND OF THE INVENTION

Water ingress into openings, such as for windows, doors, HVAC units, and/or other features may present problems in both commercial and residential structures. Roof gutters and eaves may be too far from such openings to fully alleviate the water ingress concerns. To address these limitations, drip guards have been utilized that divert water flowing from above the opening outward away from the structure. However, conventional drip guards direct the flowing water directly over the opening, which may be undesirable, especially when the drip guard is positioned over a doorway or window. Therefore, improvements in water ingress control for various structures are desired.

SUMMARY OF THE INVENTION

Embodiments of the present technology may encompass drip gutters. The drip gutters may include a vertical member. The drip gutters may include a horizontal member extending laterally outward from the vertical member. At least a portion of the vertical member may extend upward above the horizontal member. The drip gutters may include a vertical lip extending upward from a surface of the horizonal member and laterally spaced apart from the vertical member such that an open-topped drainage channel is formed between the vertical member, the horizontal member, and the vertical lip.

In some embodiments, the vertical member may have a greater height than the vertical lip. A width of the horizontal member may be greater than a height of the vertical lip. The horizontal member may extend from the vertical member at an angle of between about 75 degrees and 105 degrees. The horizontal member may slope downward from the vertical member to the vertical lip. The drip gutters may be monolithic structures. The vertical member may include a rib that protrudes from a primary surface of the vertical member in a same direction as the horizontal member. The rib may be disposed above the horizontal member. The drip gutters may include a horizontal protrusion that extends from a same surface of the vertical member as the horizontal member. The horizontal member may be spaced apart from the horizontal protrusion by a vertical distance. The horizontal protrusion may extend a shorter distance than the horizontal member. The vertical distance may be between about 0.125 inches and 0.75 inches. The horizontal protrusion may include a vertical portion that extends toward the horizontal member. The vertical portion may be coupled with the horizontal member. A length of the open-topped drainage channel may be greater than a width of the open-topped drainage channel.

Some embodiments of the present technology may encompass structures, such as utility sheds. The structures may include a vertical external surface defining an opening. The structures may include a drip gutter disposed above the opening with the drip gutter being disposed at a vertical distance of within one foot of a top of the opening. The drip gutter may include a vertical member. The drip gutter may include a horizontal member extending laterally outward from the vertical member. At least a portion of the vertical member may extend upward above the horizontal member. The drip gutter may include a vertical lip extending upward from a surface of the horizonal member and laterally spaced apart from the vertical member such that an open-topped drainage channel is formed between the vertical member, the horizontal member, and the vertical lip.

In some embodiments, the vertical exterior surface may include siding material. The vertical member of the drip gutter may be coupled with a surface of the siding material. The vertical member may be disposed on an exterior-facing surface of the siding material. The vertical member may be disposed on an interior-facing surface of the siding material. The vertical exterior surface may include trim material. The vertical member of the drip gutter may be coupled with a surface of the trim material. The vertical member may be disposed on an exterior-facing surface of the trim material. The vertical member may be disposed on an interior-facing surface of the trim material. The vertical exterior surface may include siding material and trim material. The vertical member of the drip gutter may be disposed between the trim material and the siding material. The vertical exterior surface may include exterior sheathing material and siding material. The vertical member of the drip gutter may be disposed between the exterior sheathing material and the siding material.

BRIEF DESCRIPTION OF THE DRAWINGS

A further understanding of the nature and advantages of the disclosed technology may be realized by reference to the remaining portions of the specification and the drawings.

Several of the figures are included as schematics. It is to be understood that the figures are for illustrative purposes, and are not to be considered of scale unless specifically stated to be of scale. Additionally, as schematics, the figures are provided to aid comprehension and may not include all aspects or information compared to realistic representations, and may include exaggerated material for illustrative purposes.

DETAILED DESCRIPTION OF THE INVENTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Embodiments of the present invention are directed to drip gutters that may direct downward flowing/falling water laterally away from the lateral boundaries of door and window openings. The drip gutters described herein may be mounted to an exterior surface (e.g., siding, trim, etc.) of a structure (e.g., a shed or utility shed, home, other residential building, commercial building) at areas proximate openings for doors, windows, other access points, and/or other features. For example, the drip gutters may be positioned directly above a particular opening and may prevent downward flows of water from dripping over the opening by directing the water laterally outward of a periphery of the opening.

Figure 1:
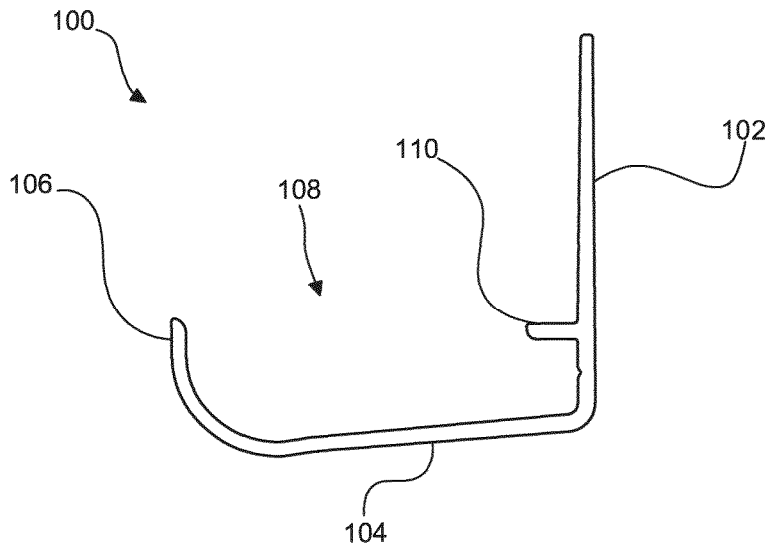
FIG. 1 shows a side elevation view of a drip gutter according to embodiments of the present invention.

Turning now to FIG. 1, an embodiment of a drip gutter 100 is illustrated. Drip gutter 100 may include a vertical member 102, which may be used to secure the drip gutter 100 to a vertical surface of a structure as will be discussed in greater detail below. The vertical member 102 may have a height of between about 0.5 inches and 12 inches, although more commonly the height of the vertical member 102 is between about 1 inch and 3.5 inches. In some embodiments, the vertical member 102 may have a thickness of between about 0.025 inch and 0.125 inch. The thickness may be constant or variable across a height of the vertical member 102. For example, the thickness of the vertical member 102 may taper from a thicker lower portion to a thinner upper portion in some embodiments, which may help the vertical member 102 sit flush against trim and/or siding (or other component) of a structure. For example, as illustrated, the vertical member 102 tapers from a thickness of 0.06 inch to 0.05 inch along the height of the vertical member 102. Other amounts of taper, such as greater or lesser taper distances, may be utilized in various embodiments. It will be appreciated that the ranges of dimensions disclosed herein are merely provided as common ranges and that the exact dimensions of the vertical member 102 may be selected based on the needs of a particular application (e.g., where and how the drip gutter 100 is mounted to a structure, dimensions of the structure's components, etc.).

A horizontal member 104 may extend laterally outward from the vertical member 102. For example, as illustrated the horizontal member 104 may extend from a bottom edge of the vertical member 102, however in other embodiments the horizontal member 104 may extend from a medial portion of the vertical member 102 such that at least a portion of the vertical member 102 extends downward beyond the horizontal member 104. Additionally, at least a portion of the vertical member 102 may extend upward above the horizontal member 104, which may enable a portion of the vertical member 102 and a top surface of the horizontal member 104 to define a drainage channel 108 as will be described more below. In some embodiments, the horizontal member 104 may be orthogonal to the vertical member 102, however in other embodiments the horizontal member 104 may extend from the vertical member 102 at an angle of between about 75 degrees and 105 degrees, although other angles are possible in various embodiments. For example, the horizontal member 104 may slope slightly downward (e.g., at an angle of greater than 90 degrees and less than or equal to 105 degrees) from the vertical member 102. The downward slope may help pull water away from the vertical member 102 to facilitate drainage of the water at positions away from the structure on which the drip gutter 100 is mounted. In some embodiments, a width of the horizontal member 104 may be between about 0.5 inch and 2.5 inches, although more commonly the width is between about 1 inch and 1.5 inches. Other widths are possible in various embodiments. In some embodiments, a junction of the vertical member 102 and the horizontal member 104 may form a sharp corner, while in other embodiments a radius may be formed between the components to soften the interface. In such embodiments, the radius may be between about 0.05 inches and 0.25 inches, although other radii may be used in various embodiments.

While not illustrated, an upper surface of the horizontal member 104 may or may not be level or planar. Instead, the upper surface of the horizontal member 104 may be arched or slanted. For example, an uppermost point in the upper surface of the horizontal member 104 may be positioned proximate the vertical member 102, with a low point of the horizontal member 104 being positioned at an end of the horizontal member 104 that is furthest from the vertical member 102. Such positioning may cause water to flow to the low point, away from the structure on which the drip gutter 100 is mounted. Other configurations are possible. For example, in some embodiments, a medial region of the width (e.g., dimension from left to right as illustrated) of the horizontal member 104 may be depressed relative to one or both ends, which may cause water to be directed into the medial region of the width of the horizontal member 104. Additionally, or alternatively, outer edges of the upper surface of the horizontal member 104, along the length of the horizontal member 104, may be lower than the uppermost point (which may be positioned in a medial region and/or center of the length (e.g., direction going into the figure as illustrated) of the horizontal member 104) or may be the lowest points of the horizontal member 104. By having uppermost point at or near the center of the horizontal member 104 with lower points near the ends of the horizontal member 104, downward flowing/falling water may be directed laterally outward and off the horizontal member 104.

A vertical lip 106 may extend upward from a surface of the horizonal member 104 to collect water and direct the water toward a lateral edge of a structural opening. The vertical lip 106 may extend from a distal end (e.g., end opposite the vertical member 102) of the horizontal member 104, or may be disposed at a medial portion of the horizontal member 104. In some embodiments, the distal end of the horizontal member 104 may be bent upward to form the vertical lip 106. The vertical lip 106 may be laterally spaced apart from the vertical member 102 such that an open-topped drainage channel 108 is formed between the vertical member 102, the horizontal member 104, and the vertical lip 106. The drainage channel 108 may extend along all or a portion of a length of the drip gutter 100. The vertical lip 106 may extend upward along only a portion of the height of the vertical member 102. In other words, the vertical member 102 may have a greater height than the vertical lip 106 in some embodiments. In some embodiments, a width of the horizontal member 104 may be greater than a height of the vertical lip 106 such that a depth of the drainage channel 108 is less than a width of the drainage channel 108. A length (e.g., direction going into the figure as illustrated and/or across a width of an opening of a structure about which the drip gutter 100 is mounted) of the drainage channel 108 may be greater than a width (e.g., a distance between the vertical member 102 and the vertical lip 106) of the drainage channel 108 in some embodiments.

In some embodiments, the vertical lip 106 may be a linear member, while in other embodiments, the vertical lip 106 may be curved. In such embodiments, the radius of the curve may be between about 0.05 inches and 1 inch, although other radii may be used in various embodiments. In some embodiments, the curve may have a constant radius, while in other embodiments the radius may vary. The horizontal member 104 may be planar, while in other embodiments the horizontal member 104 may include one or more contours. For example, as illustrated a distal end of the horizontal member 104 (proximate the vertical lip 106) may curve and/or otherwise protrude slightly downward. In a particular embodiment, the distal end of the horizontal member 104 may transition to an upward-facing arc portion and/or radius that is slightly lower than the rest of the horizontal member 104. This lower region may form a primary drainage portion of the drainage channel 108. For example, water may flow into the lower region and be directed laterally outward away from a structural opening. Additionally, due to surface tension, any water droplets/pools/streams contacting other water droplets/pools/streams within the lower region may be drawn into the lower region, which may facilitate improved drainage of water within the drainage channel 108. In some embodiments, the lower region may be formed as part of a transition between the horizontal member 104 and the vertical lip 106. For example, the lower region and the vertical lip 106 may be formed as a curved portion with a constant and/or variable radius, with the radius protruding slightly downward from a bottom surface of the horizontal member 104. In some embodiments, the lower region may be between about 0.005 and 0.5 inches lower than the lowest planar region of the horizontal member 104, although other distances are possible in various embodiments.

In some embodiments, the drip gutter 100 may include a horizontal protrusion 110 that extends from a same surface of the vertical member 102 as the horizontal member 104. For example, the horizontal protrusion 110 may be positioned above and spaced apart from the horizontal member 104 by a vertical distance. In some embodiments, the vertical distance may be between about 0.125 inches and 0.75 inches, although other distances are possible in various embodiments. The horizontal protrusion 110 may provide a ledge or other support surface on which a trim and/or siding material of a structure may be supported, with the ledge maintaining the trim and/or siding material a distance above a bottom surface of the drainage channel 108 to keep the trim and/or siding from sitting in water collected within the drainage channel 108. The horizontal protrusion 110 may extend a shorter distance than the horizontal member 104, which may ensure that the top of at least a portion of the drainage channel 108 remains open to collect downward moving water. For example, a width of the horizontal protrusion 110 may be between or about 0.05 inch and 0.5 inch, and more commonly between about 0.15 inch and 0.25 inch. While not shown, in some embodiments the horizontal protrusion 110 may include a vertical portion that extends downward all or a portion of the distance toward the horizontal member 104. In some embodiments, the vertical portion may extend into and/or be coupled with the horizontal member 104. The vertical portion of the horizontal protrusion 110 may additionally or alternatively extend upward all or a portion of the distance toward an upper end of the vertical member 102. An upward vertical extension of the horizontal protrusion may allow for trim and/or siding to be seated on and secured in the horizontal protrusion 110.

Figure 2:
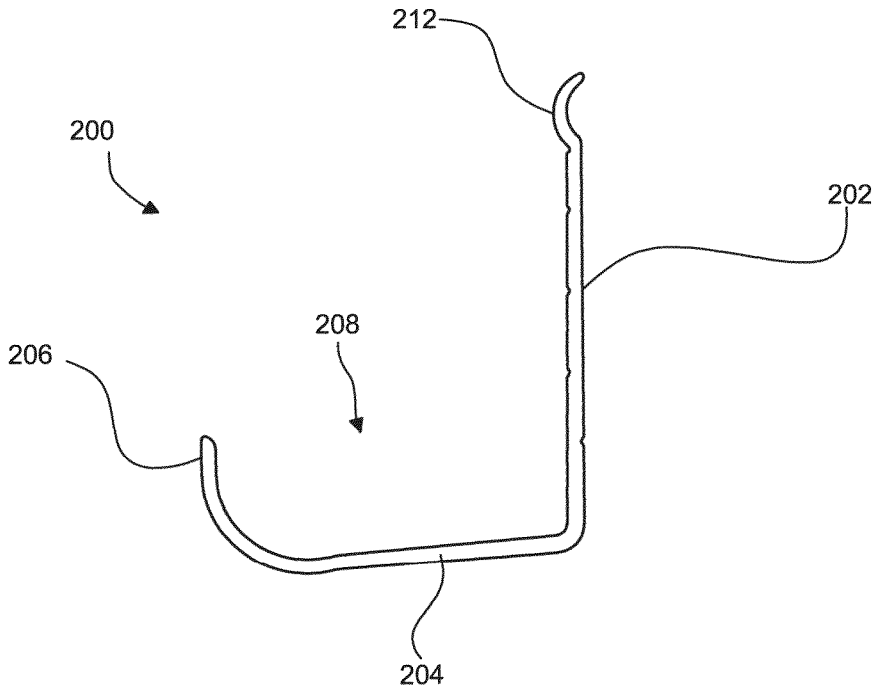
FIG. 2 shows a side elevation view of a drip gutter according to embodiments of the present invention.

FIG. 2 illustrates another embodiment of a drip gutter 200. Drip gutter 200 may include any of the features described in relation to drip gutter 100. For example, drip gutter 200 may include a vertical member 202, a horizontal member 204, a vertical lip 206, drainage channel 208, and/or a horizontal protrusion (not shown). In some embodiments, the vertical member 202 may define or include one or more ribs 212 that protrude from a primary surface of the vertical member 202 in a same direction as the horizontal member 204, with the rib 212 being disposed above the horizontal member 204 in some embodiments. In a particular embodiment, the rib 212 may be formed as an arc-shaped bend in the vertical member 202. A concave back side of the rib 212 may provide a volume for applying silicone, caulking, and/or another sealing agent to help seal an interface between the drip gutter 200 and a structure on which the drip gutter 200 is mounted. Additionally, or alternatively, the rib 212 may help prevent the drip gutter 200 from bowing and/or otherwise deforming upon tightening of fasteners (such as screws, nails, etc.) that may be used to secure the drip gutter 200 to the structure.

In some embodiments, the drip gutters described herein may be formed as monolithic structures. For example, the drip gutters may be extruded, cast, bent, and/or otherwise formed from a single piece of material, such as aluminum, steel (e.g., stainless steel), other metal, plastic, wood, and/or other material. The monolithic structure may provide improved drainage and sealing properties. In other embodiments, multiple pieces of a same or different material may be separately formed and later joined (e.g., using fasteners, welding, adhesives, etc.) to form the drip gutters.

Figures 3A, 3B, 3C:
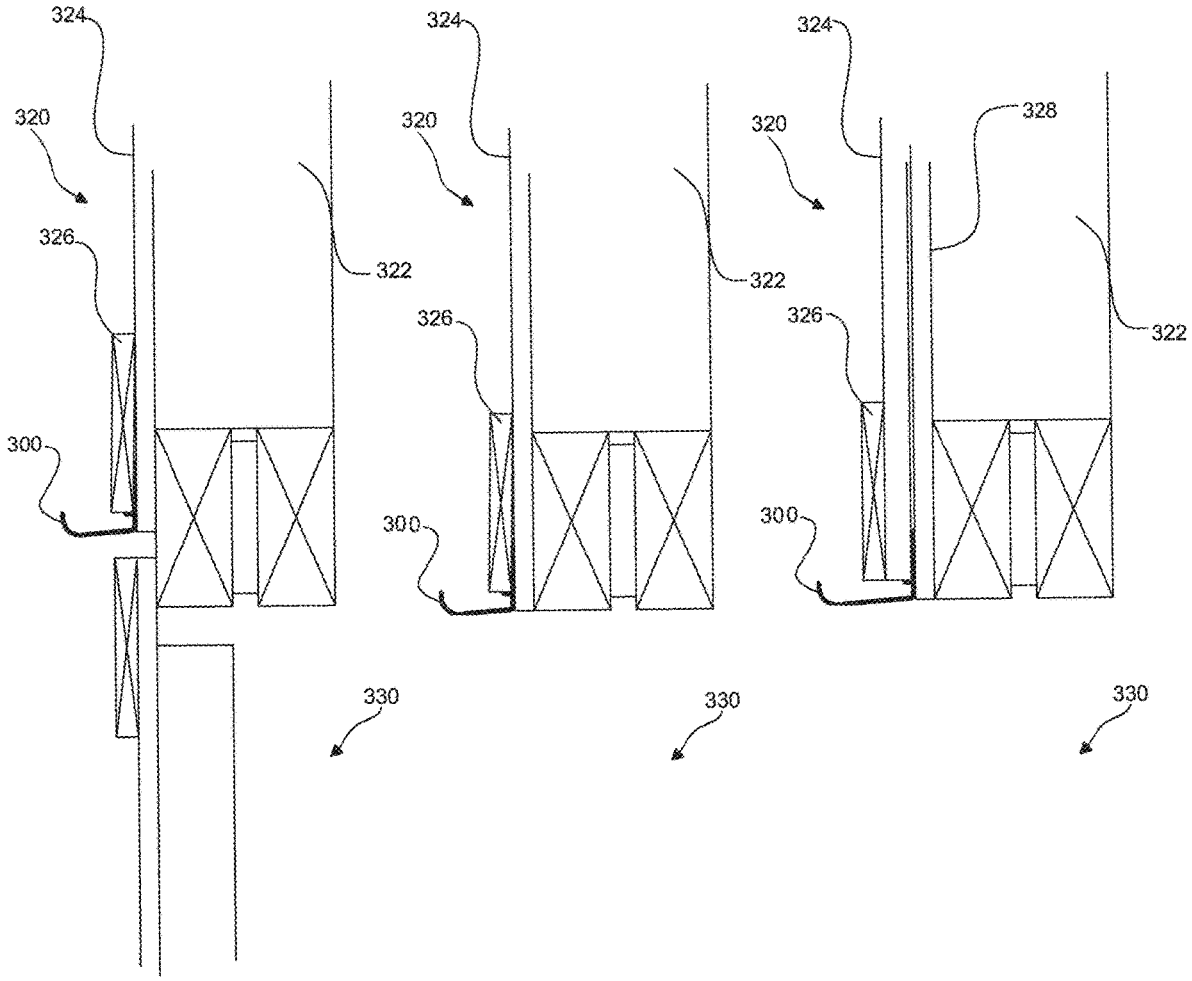
FIG. 3A shows a side elevation cross-sectional view of a drip gutter affixed to a structure according to embodiments of the present invention.
FIG. 3B shows a side elevation cross-sectional view of a drip gutter affixed to a structure according to embodiments of the present invention.
FIG. 3C shows a side elevation cross-sectional view of a drip gutter affixed to a structure according to embodiments of the present invention.

FIGS. 3A-3D illustrate a drip gutter 300 that is coupled with a structure 320. The drip gutter 300 may be similar to drip gutter 100 and may include any of the features described in relation to drip gutter 100. The structure 320 may be any fixed or portable structure. As just a few examples, the structure 300 may be a residential building, commercial building, storage building (such as a shed or utility shed), a vehicle (such as a recreational vehicle, camper, or commercial vehicle), and/or other structure. The structure 320 may include an exterior vertical surface that defines one or more openings 330, such as openings for doors, windows, and/or other wall penetrations. The structure 320 defines an opening 330, such as for a door and/or window. The vertical surface may include a wall structure 322 (e.g., frame and/or header), which provide structural support to the structure 320. The vertical surface may also include siding material 324 and/or trim material 326, which may be disposed against an outward-facing surface of the siding material 324. The drip gutter 300 may be disposed above the opening 330, with the drip gutter 300 being disposed at a vertical distance of within one foot of a top of the opening 330. Oftentimes, a lower surface (e.g., a horizontal member) of the drip gutter 300 may be disposed within about 6 inches, within about 3 inches, within about 1 inch, or less of the top of the opening 330. As illustrated in FIGS. 3A and 3B, the drip gutter 300 may be disposed between the siding material 324 and the trim material 326. For example, a rear face of a vertical member of the drip gutter 300 may be positioned against an outer surface of the siding material 324, with a front face of the vertical member of the drip gutter 300 being positioned against an inner surface of the trim material 326 such that at least a portion of the vertical member is sandwiched between the siding material 324 and the trim material 326. In some embodiments, a bottom surface of the trim material 326 may be seated atop a horizontal protrusion of the drip gutter 300, which may help keep the bottom surface of the trim material 326 out of a drainage channel of the drip gutter 300. While not illustrated, it is contemplated that the trim material 326 may be tapered or include a notch for mating and/or interfacing with the drip gutter 300. For example, the notch and/or taper of the trim material 326 may be sized and shaped/angled such that all or a portion of a rear surface of the trim material 326 may sit flush against the front face of the vertical member of the drip gutter 300. In other embodiments, the trim material 326 may not include a notch and/or taper and may be slightly flexed relative to the siding material 324 to accommodate the thickness of the vertical member of the drip gutter 300. Alternatively, a height of the trim material 326 may be about equal to a height of the vertical member of the drip gutter 300. In such embodiments, a taper or notch in the trim material 326 may not be necessary for the trim material 326 to sit flush with the drip gutter 300.

In some embodiments, the bottom surface of the drip gutter 300 may be disposed at or below the top of the opening 330, such as shown in FIG. 3B. In other embodiments, the drip gutter 300 may be elevated relative to the top of the opening 330. This may be particularly beneficial, for example, where the opening 330 is for a door that includes a trim piece and/or sealing member, as the elevation of the drip gutter 300 may provide clearance for the trim piece and/or sealing member of the door. Such an elevated position of the drip gutter 300 is illustrated in FIG. 3A.

In some embodiments, the vertical member of the drip gutter 300 may be positioned inward of the siding material 324 (with or without the presence of trim material 326). For example, as illustrated in FIG. 3C, the vertical member of the drip gutter 300 may be disposed between the siding material 324 and a structural sheathing material 328. A bottom edge of the siding material 324 and/or trim material 326 may be supported atop the horizontal protrusion of the drip gutter 300.

As previously discussed, a width of the horizontal member of the drip gutter 300 may be between about 0.5 inch and 3.5 inches. The width of the horizontal member may be selected based on the location of the drip gutter 300. For example, the drip gutter 300 may be characterized by a reduced width when the vertical member of the drip gutter 300 is positioned outside the siding material 324, such as in FIGS. 3A and 3B. Conversely, the horizontal member of the drip gutter 300 may be characterized by an increased width when the vertical member of the drip gutter 300 is positioned inside the siding material, such as in FIG. 3C. The difference in width of the horizontal member of the drip gutter 300 may allow for adequate downward water capture and retention without protruding further than necessary for adequate function.

Figure 3D:
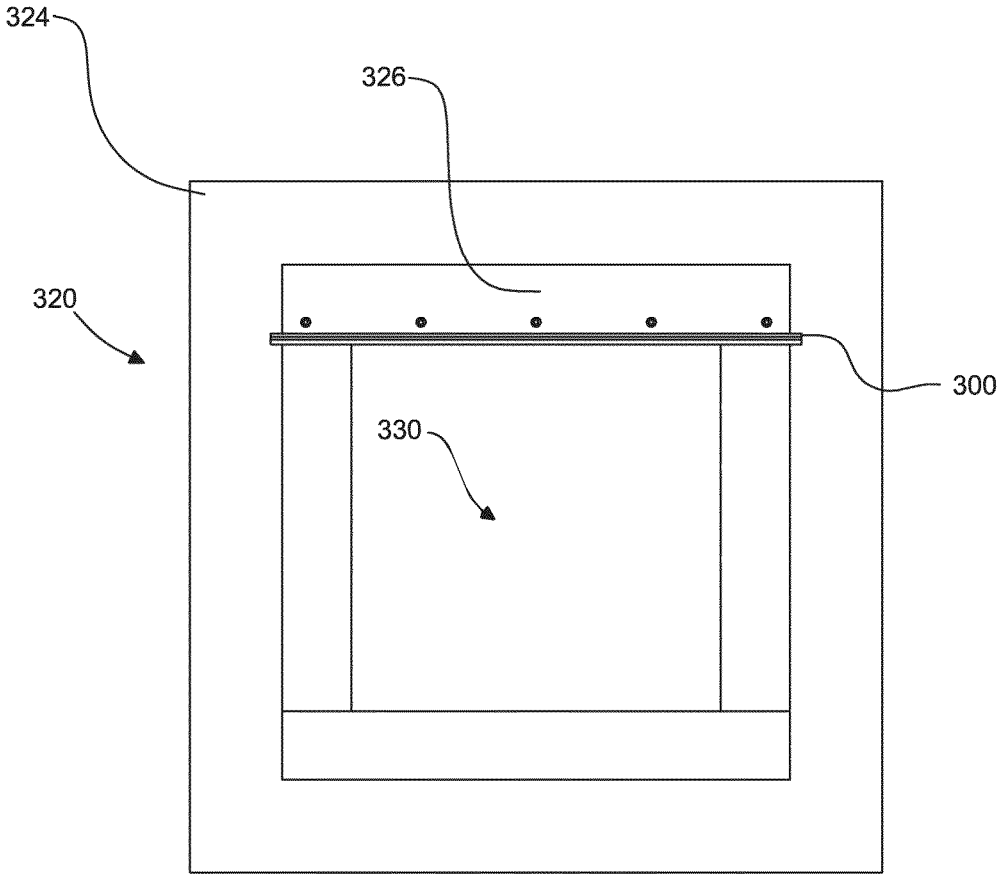
FIG. 3D shows a front elevation view of a drip gutter affixed to a structure according to embodiments of the present invention.

FIG. 3D illustrates a front view of drip gutter 300 secured above a window opening 330 of structure 320. The drainage channel of the drip gutter 300 may have a length that matches a width of the opening 330 in some embodiments. In other embodiments, the length may exceed or be less than a width of the opening 330. In embodiments in which the length of the drainage channel matches or exceeds a width of the opening 330, water may be directed laterally outward beyond the lateral boundaries of the opening 330, which may help prevent water from dripping onto people and/or objects passing through the opening 330 and/or leaking through a top and/or edge of the door, window, and/or other opening 330. In some embodiments, the vertical member of the drip gutter 300 may have a same length as the horizontal member of the drip gutter 300. In other embodiments, the vertical member and horizontal member of the drip gutter 300 may have different lengths. For example, the horizontal member may be longer than the vertical member, which may enable the vertical member to be entirely obscured by the trim material 326 while the horizontal member extends laterally outward of the trim material 326.

The drip gutter 300 may be secured to the structure 320 using one or more fasteners (e.g., nails, screws, etc.), via adhesives (e.g., water-activated adhesives, pressure sensitive adhesives, etc.), and/or using other coupling techniques. In some embodiments, fasteners used to secure the trim material 326 and/or siding material 324 to the sheathing material 328 and/or wall structure 322 may also secure the drip gutter 300 to the structure 320.

FIGS. 4A-4D illustrate a drip gutter 400 that is coupled with a structure 420. The drip gutter 400 may be similar to drip gutter 200 and may include any of the features described in relation to drip gutter 200. The structure 420 may be similar to structure 320 and may include an exterior vertical surface that defines one or more openings 430. The vertical surface may include a wall structure 422 (e.g., frame and/or header), which provide structural support to the structure 420. The vertical surface may also include siding material 424, trim material 426, and/or sheathing material 428 similar to those described above. The drip gutter 400 may be disposed above the opening 430, with the drip gutter 400 being disposed at a vertical distance of within one foot of a top of the opening 430. Oftentimes, a lower surface (e.g., a horizontal member) of the drip gutter 400 may be disposed within about 6 inches, within about 3 inches, within about 1 inch, or less of the top of the opening 430. The drip gutter 400 may be disposed against an exterior-facing surface of the trim material 426 and/or siding material 424 in some embodiments. For example, a rear face of a vertical member of the drip gutter 400 may be positioned against an outer surface of the trim material 426 and/or siding material 424, with the front surface of the vertical member remaining exposed and providing an open-topped drainage channel. While not illustrated, it is contemplated that the trim material 426 may be tapered or include a notch for mating and/or interfacing with the drip gutter 400. Alternatively, a height of the trim material 426 may be about equal to a height of the vertical member of the drip gutter 400. In such embodiments, a taper or notch in the trim material 426 may not be necessary for the trim material 426 to sit flush with the drip gutter 400.

Figures 4A, 4B, 4C:
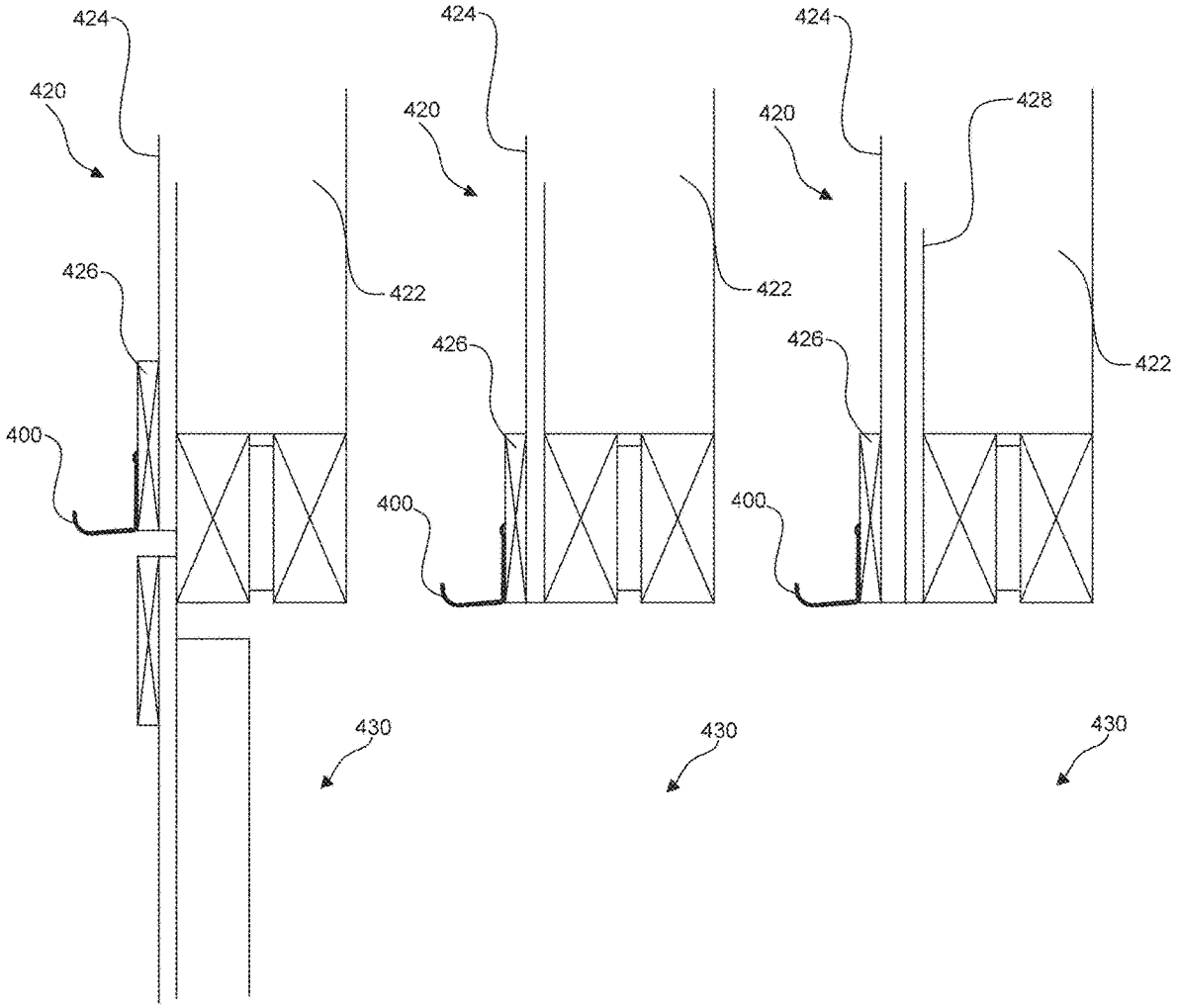
FIG. 4A shows a side elevation cross-sectional view of a drip gutter affixed to a structure according to embodiments of the present invention.
FIG. 4B shows a side elevation cross-sectional view of a drip gutter affixed to a structure according to embodiments of the present invention.
FIG. 4C shows a side elevation cross-sectional view of a drip gutter affixed to a structure according to embodiments of the present invention.

In some embodiments, the bottom surface of the drip gutter 400 may be disposed at or below the top of the opening 430, such as shown in FIGS. 4B and 4C. In other embodiments, the drip gutter 400 may be elevated relative to the top of the opening 430. This may be particularly beneficial, for example, where the opening 430 is for a door that includes a trim piece and/or sealing member, as the elevation of the drip gutter 400 may provide clearance for the trim piece and/or sealing member of the door. Such an elevated position of the drip gutter 300 is illustrated in FIG. 4A.

Figure 4D:
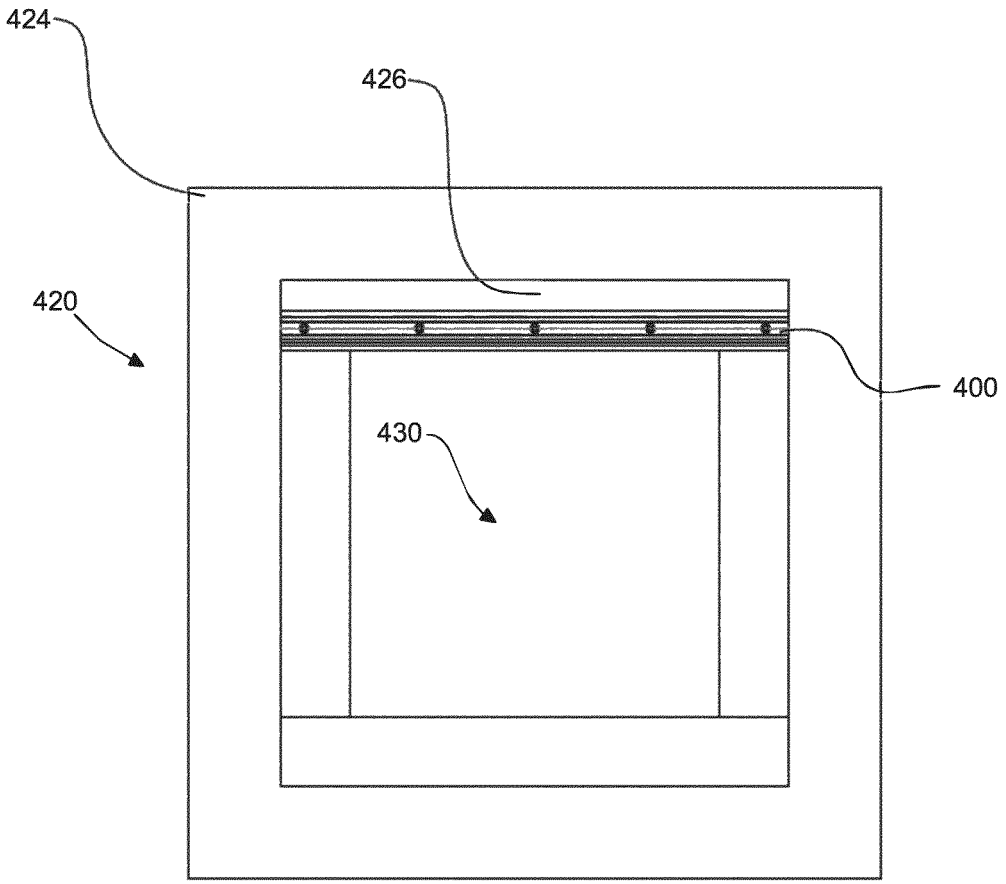
FIG. 4D shows a front elevation view of a drip gutter affixed to a structure according to embodiments of the present invention.

FIG. 4D illustrates a front view of drip gutter 400 secured above a window opening 430 of structure 420. The drainage channel of the drip gutter 400 may have a length that matches a width of the opening 430 in some embodiments. In other embodiments, the length may exceed or be less than a width of the opening 430. In embodiments in which the length of the drainage channel matches or exceeds a width of the opening 430, water may be directly laterally outward beyond the lateral boundaries of the opening 430, which may help prevent water from dripping onto people and/or objects passing through the opening 430. In some embodiments, the vertical member of the drip gutter 400 may have a same length as the horizontal member of the drip gutter 400. In other embodiments, the vertical member and horizontal member of the drip gutter 400 may have different lengths.

The drip gutter 400 may be secured to the structure 420 using one or more fasteners (e.g., nails, screws, etc.), via adhesives (e.g., water-activated adhesives), and/or using other coupling techniques. In some embodiments, fasteners used to secure the trim material 426 and/or siding material 424 to the sheathing material 428 and/or wall structure 422 may also secure the drip gutter 400 to the structure 420. In some embodiments, silicone, caulking, and/or other sealant may be disposed within the rib of the vertical member of the drip gutter 400 to prevent water from getting behind the drip gutter 400.

Figure 5A:
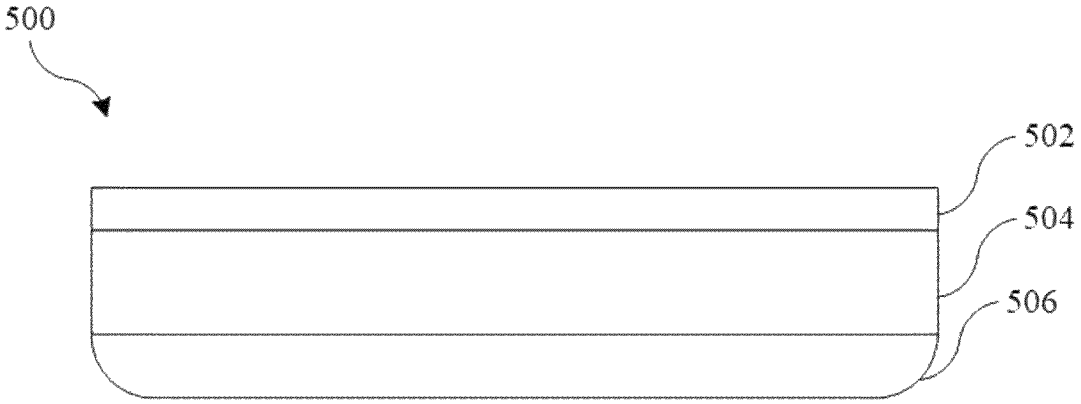
FIG. 5A shows a top plan view of a drip gutter according to embodiments of the present invention.
Figure 5B:
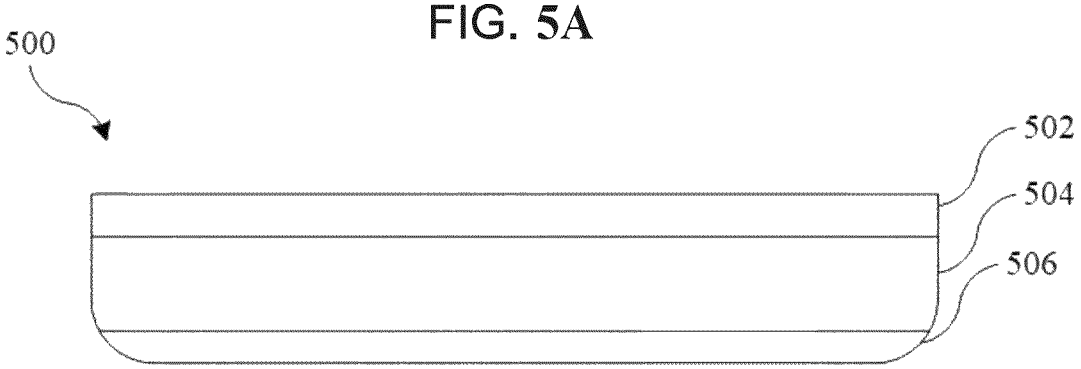
FIG. 5B shows a top plan view of a drip gutter according to embodiments of the present invention.

FIGS. 5A and 5B illustrate top plan views of a drip gutter 500. The drip gutter 500 may be similar to drip gutter 100 or 200 and may include any of the features described in relation to drip gutter 100 or 200. As illustrated in FIGS. 5A and 5B, outer corners of the drip gutter 500 opposite the vertical member 502 may be rounded. In such embodiments, a portion of the horizontal member 504 and/or the vertical lip 506 may extend less than the entire length of the vertical member 502. In some embodiments, as illustrated in FIG. 5A, at outer corners opposite the vertical member 502, the vertical lip 506 may be extend less than an entire length of the vertical member 502 and/or the horizontal member 504. In other embodiments, as illustrated in FIG. 5B, at outer corners opposite the vertical member 502, both the horizontal member 504 and the vertical lip 506 may be extend less than an entire length of the vertical member 502. The rounded corners may reduce material cost and/or prevent snagging or catching other items or objects. In embodiments, a radius of the rounded corners may be between about 0.125 inches and about 0.5 inches.

It should be noted that the systems and devices discussed above are intended merely to be examples. It must be stressed that various embodiments may omit, substitute, or add various procedures or components as appropriate. Also, features described with respect to certain embodiments may be combined in various other embodiments. Different aspects and elements of the embodiments may be combined in a similar manner. Also, it should be emphasized that technology evolves and, thus, many of the elements are examples and should not be interpreted to limit the scope of the invention.

Specific details are given in the description to provide a thorough understanding of the embodiments. However, it will be understood by one of ordinary skill in the art that the embodiments may be practiced without these specific details. For example, well-known structures and techniques have been shown without unnecessary detail in order to avoid obscuring the embodiments. This description provides example embodiments only, and is not intended to limit the scope, applicability, or configuration of the invention. Rather, the preceding description of the embodiments will provide those skilled in the art with an enabling description for implementing embodiments of the invention. Various changes may be made in the function and arrangement of elements without departing from the spirit and scope of the invention.

Having described several embodiments, it will be recognized by those of skill in the art that various modifications, alternative constructions, and equivalents may be used without departing from the spirit of the invention. For example, the above elements may merely be a component of a larger system, wherein other rules may take precedence over or otherwise modify the application of the invention. Also, a number of steps may be undertaken before, during, or after the above elements are considered. Accordingly, the above description should not be taken as limiting the scope of the invention.

Also, the words "comprise", "comprising", "contains", "containing", "include", "including", and "includes", when used in this specification and in the following claims, are intended to specify the presence of stated features, integers, components, or steps, but they do not preclude the presence or addition of one or more other features, integers, components, steps, acts, or groups.

Unless defined otherwise, all technical and scientific terms used herein have the same meaning as commonly or conventionally understood. As used herein, the articles "a" and "an" refer to one or to more than one (i.e., to at least one) of the grammatical object of the article. By way of example, "an element" means one element or more than one element. "About" and/or "approximately" as used herein when referring to a measurable value such as an amount, a temporal duration, and the like, encompasses variations of ±20% or ±10%, ±5%, or ±0.1% from the specified value, as such variations are appropriate to in the context of the systems, devices, circuits, methods, and other implementations described herein. "Substantially" as used herein when referring to a measurable value such as an amount, a temporal duration, a physical attribute (such as frequency), and the like, also encompasses variations of ±20% or ±10%, ±5%, or ±0.1% from the specified value, as such variations are appropriate to in the context of the systems, devices, circuits, methods, and other implementations described herein.

As used herein, including in the claims, "and" as used in a list of items prefaced by "at least one of" or "one or more of" indicates that any combination of the listed items may be used. For example, a list of "at least one of A, B, and C" includes any of the combinations A or B or C or AB or AC or BC and/or ABC (i.e., A and B and C). Furthermore, to the extent more than one occurrence or use of the items A, B, or C is possible, multiple uses of A, B, and/or C may form part of the contemplated combinations. For example, a list of "at least one of A, B, and C" may also include AA, AAB, AAA, BB, etc.

What is claimed is:

1. A drip gutter for a utility shed, comprising:

a vertical member;

a horizontal member extending laterally outward from the vertical member, wherein at least a portion of the vertical member extends upward above the horizontal member;

a vertical lip extending upward from a surface of the horizonal member and laterally spaced apart from the vertical member such that an open-topped drainage channel is formed between the vertical member, the horizontal member, and the vertical lip; and a horizontal protrusion that extends from a same surface of the vertical member as the horizontal member, the horizontal member being spaced apart from the horizontal protrusion by a vertical distance, wherein:

the horizontal protrusion extends a shorter distance than the horizontal member; and the horizontal protrusion is configured to support one or both of a siding material or a trim material located on the utility shed at a predetermined distance above a bottom surface of the drainage channel.

2. The drip gutter of claim 1, wherein:

the vertical member has a greater height than the vertical lip.

3. The drip gutter of claim 1, wherein:

a width of the horizontal member is greater than a height of the vertical lip.

4. The drip gutter of claim 1, wherein:

the horizontal member extends from the vertical member at an angle of between about 75 degrees and 105 degrees.

5. The drip gutter of claim 1, wherein:

the horizontal member slopes downward from the vertical member to the vertical lip.

6. The drip gutter of claim 1, wherein:

the drip gutter is a monolithic structure.

7. The drip gutter of claim 1, wherein:

the vertical member comprises a rib that protrudes from a primary surface of the vertical member in a same direction as the horizontal member; and the rib is disposed above the horizontal member.

8. The drip gutter of claim 1, wherein:

the vertical distance is between about 0.125 inches and 0.75 inches.

9. The drip gutter of claim 1, wherein:

a length of the open-topped drainage channel is greater than a width of the open-topped drainage channel.

10. The drip gutter of claim 1, wherein:

the horizontal protrusion comprises a vertical portion that extends toward the horizontal member.

11. The drip gutter of claim 10, wherein:

the vertical portion is coupled with the horizontal member.

12. A utility shed comprising:

a vertical exterior surface defining an opening, wherein the vertical exterior surface comprises one or both of a siding material and a trim material; and a drip gutter in alignment with the opening with the drip gutter being disposed at a vertical distance of within one foot of a top of the opening, the drip gutter comprising:

a vertical member that is disposed on an interior-facing surface of at least one of the one or both of the siding material and the trim material;

a horizontal member extending laterally outward from the vertical member, wherein at least a portion of the vertical member extends upward above the horizontal member; and a vertical lip extending upward from a surface of the horizonal member and laterally spaced apart from the vertical member such that an open-topped drainage channel is formed between the vertical member, the horizontal member, and the vertical lip.

13. The utility shed of claim 12, wherein:

the vertical exterior surface comprises the siding material and the trim material; and the vertical member of the drip gutter is disposed between the trim material and the siding material.

14. The utility shed of claim 12, wherein:

the vertical exterior surface comprises exterior sheathing material and the siding material; and the vertical member of the drip gutter is disposed between the exterior sheathing material and the siding material.

15. The utility shed of claim 12, wherein:

the vertical exterior surface comprises the trim material; and the vertical member of the drip gutter is coupled with a surface of the trim material.

16. The utility shed of claim 15, wherein:

the vertical member is disposed on the interior-facing surface of the trim material.

17. The utility shed of claim 12, wherein:

the vertical exterior surface comprises the siding material; and the vertical member of the drip gutter is coupled with a surface of the siding material.

18. The utility shed of claim 17, wherein:

the vertical member is disposed on an exterior-facing surface of the siding material.

19. The utility shed of claim 17, wherein:

the vertical member is disposed on the interior-facing surface of the siding material.

* * * * *